US006722671B2

(12) United States Patent
Be

(10) Patent No.: US 6,722,671 B2
(45) Date of Patent: Apr. 20, 2004

(54) BAG BODY FOR BOWLING BAGS

(76) Inventor: Sung Hoan Be, 877-Kumdan-dong, Buk-gu, Taegu (KR)

( * ) Notice: Subject to any disclaimer, the term of this patent is extended or adjusted under 35 U.S.C. 154(b) by 57 days.

(21) Appl. No.: 09/785,582

(22) Filed: Feb. 20, 2001

(65) Prior Publication Data

US 2002/0113386 A1 Aug. 22, 2002

(51) Int. Cl.[7] ..... B62B 1/00

(52) U.S. Cl. ..... 280/47.26; 206/315.9; 220/524

(58) Field of Search ..... 280/47.26, 47.19; 206/315.91, 315.1, 315.9; 190/18 A; 220/524; D03/254, 257, 258; 224/919

(56) References Cited

U.S. PATENT DOCUMENTS 3,308,911 A * 3/1967 Stevens et al. ..... 206/315.9
4,066,156 A * 1/1978 Basile ..... 190/18 A
4,319,617 A * 3/1982 Fusaro ..... 206/315.1
4,658,298 A * 4/1987 Takeda et al. ..... 206/320
4,895,230 A * 1/1990 King ..... 190/107
5,074,571 A * 12/1991 Reese ..... 190/18 A
5,105,919 A * 4/1992 Bomes et al. ..... 150/117
D349,401 S * 8/1994 Carrillo ..... D3/221
5,791,469 A * 8/1998 Be ..... 190/18 A
5,871,092 A * 2/1999 Rogers et al. ..... 206/315.1
5,931,120 A * 8/1999 Burns et al. ..... 119/497
6,021,740 A * 2/2000 Martz ..... 119/482
6,099,023 A * 8/2000 Be ..... 190/18 A
6,109,627 A * 8/2000 Be ..... 190/18 A
6,126,012 A * 10/2000 Roegner ..... 150/112
6,439,389 B1 * 8/2002 Mogil ..... 206/217

* cited by examiner

*Primary Examiner*—Brian L. Johnson
*Assistant Examiner*—Christopher Bottorff
(74) *Attorney, Agent, or Firm*—Jacaobson Homan, PLLC

(57) ABSTRACT

A bag body for bowling bags. The bag body includes an elongated body member that is provided with a cavity and side open ends. Two lids are hinged to the body member at the side open ends of the body member to selectively open and close the side open ends, and provided with an exterior pouch. A partition is formed in the center portion of the cavity of the body member to divide the cavity into two sub-cavities. The partition may be pectinate and integrated with the body member into a single structure. The bag body may further comprise a cover made of synthetic resin of leather, the cover being provided with an auxiliary pouch and secured to the front portion of the body member by means of bars and bolts.

18 Claims, 12 Drawing Sheets

BAG BODY FOR BOWLING BAGS

BACKGROUND OF THE INVENTION

1. Field of the Invention

The present invention relates generally to bowling bags used to keep and carry bowling equipment such as bowling balls and bowling shoes, and more particularly to a bowling bag in which a partition is formed in the center portion of the cavity of the bag to divide the cavity into two sub-cavities, thereby allowing bowling balls to be individually put into and withdrawn from the bag. The present invention is an improvement over U.S. Pat. No. 6,109,627 entitled "bowling bag" and Korean Pat. Appln. No. 10-2000-0056673 entitled "bottom case for bowling bags".

2. Description of the Prior Art

U.S. Pat. No. 6,109,627 discloses a bowling ball carrier invented by this inventor, in which a plurality of bowling bags are attached to a carrier with one laid on top of another, and fabric lids are sewn around the front openings of bag bodies or lids of synthetic resin are respectively hinged around the front openings of the bag bodies to allow bowling balls to be put into and withdrawn from the bags. The lids are formed in the fronts of bag bodies, since the bowling balls cannot be put into or withdrawn from the stacked bags if lids are formed on the tops of the bag bodies. Accordingly, two bowling balls are kept in a single cavity, so a problem occurs in which scratches and noise are created due to the collision between the balls. Additionally, the lids are formed on the fronts of the bowling bags, so a bowling ball present in the bowling bag easily falls out because of a user's carelessness and external impact while the bowling ball carrier is erect.

In order to overcome the shortcomings of U.S. Pat. No. 6,109,627, U.S. Pat No. 6,099,023 has been proposed by this inventor. U.S. Pat. No. 6,099,023 discloses a bottom case for bowling bags in which one or two partition walls are integrally formed in the bottom case, thus forming one, two or three cells in the case and allowing bowling balls to be individually kept in the cells. The bowling bag equipped with the bottom case can eliminate the problem of bowling balls colliding with each other, but creates another problem in which a bowling ball present in the bag easily can fall out because a single lid is formed in the front of the bowling bag. This problem causes inconvenience to a user in which the user has to put a bowling ball into the bowling bag and to withdraw a bowling ball from the bowling bag when the bowling ball carrier is laid on a floor.

SUMMARY OF THE INVENTION

Accordingly, the present invention has been made keeping in mind the above problems occurring in the prior art, and an object of the present invention is to provide a bowling bag, in which its cavity is divided into two sub-cavities and its side open ends are respectively equipped with two lids, so that two bowling balls can be individually put into and individually withdrawn from the bag.

In order to accomplish the above object, the present invention provides a bag body for bowling bags, comprising an elongated body member having a cavity and side open ends, two lids hinged to the body member at the side open ends of the body member to selectively open and close the side open ends, and provided with an exterior pouch, and a partition formed in the center portion of the cavity of the body member to divide the cavity into two sub-cavities.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
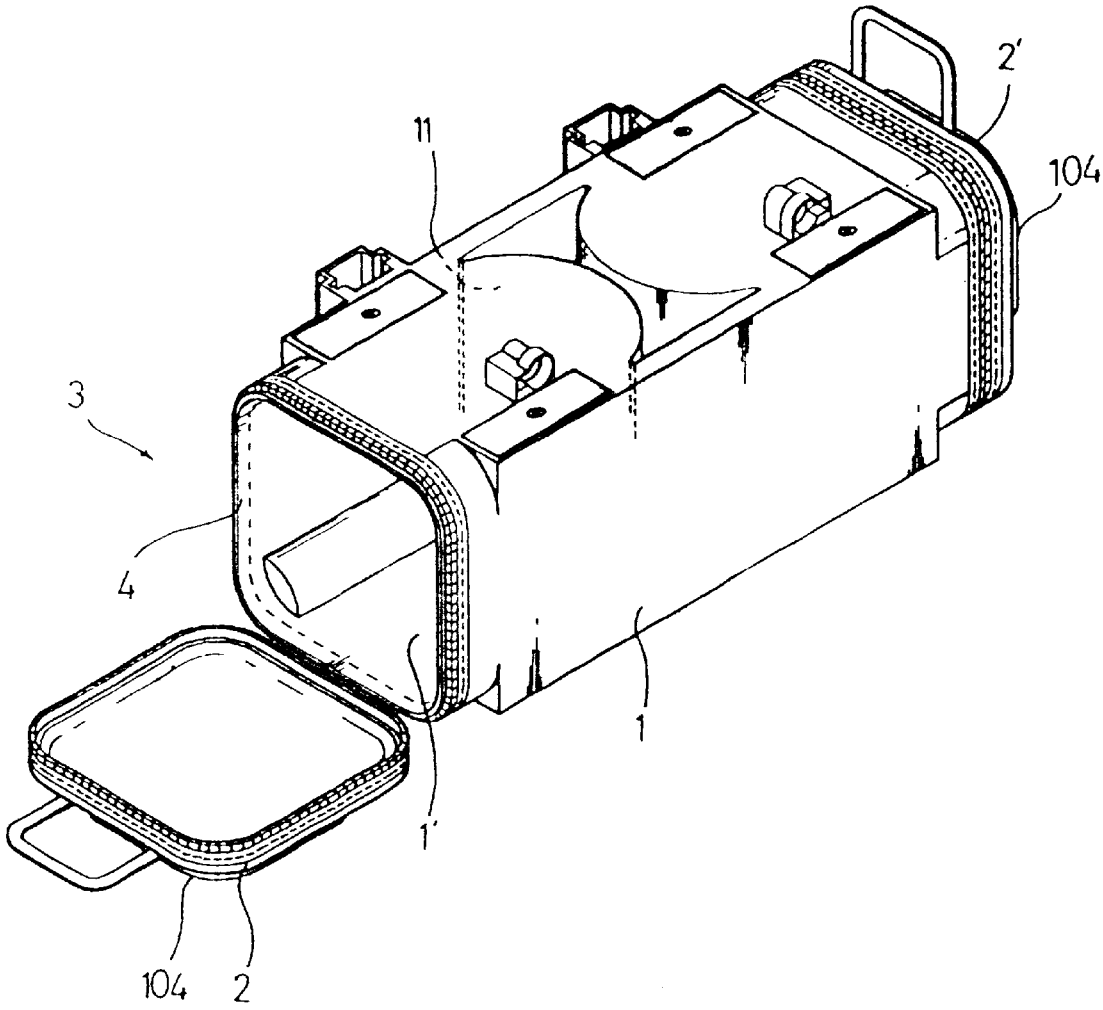
FIG. 1 is a perspective view showing a bag body for bowling bags in accordance with the present invention.

Reference now should be made to the drawings, in which the same reference numerals are used throughout the different drawings to designate the same or similar components.

Figure 2:
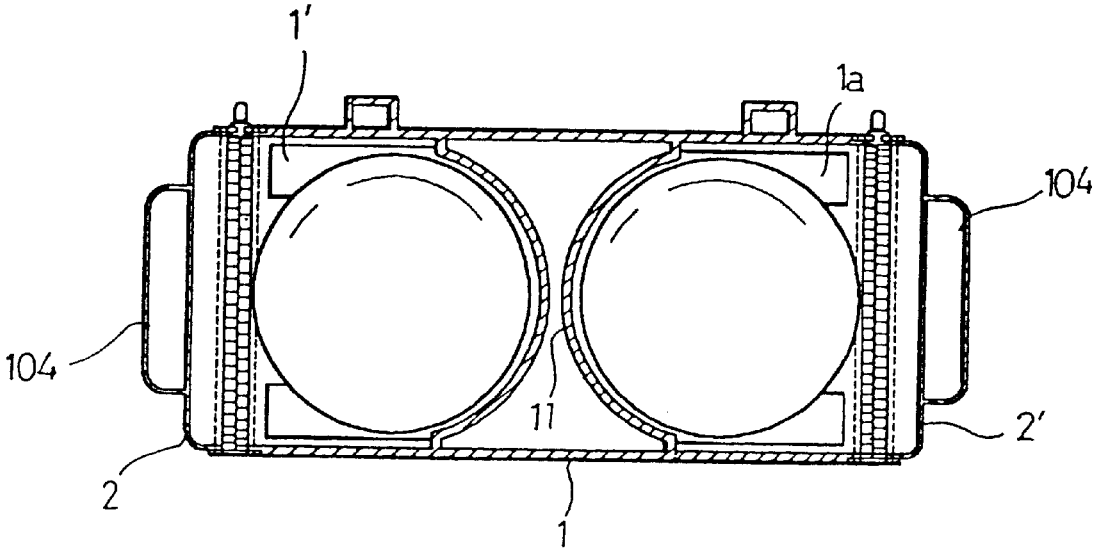
FIG. 2 is a horizontal cross-section of FIG. 1.
Figure 3:
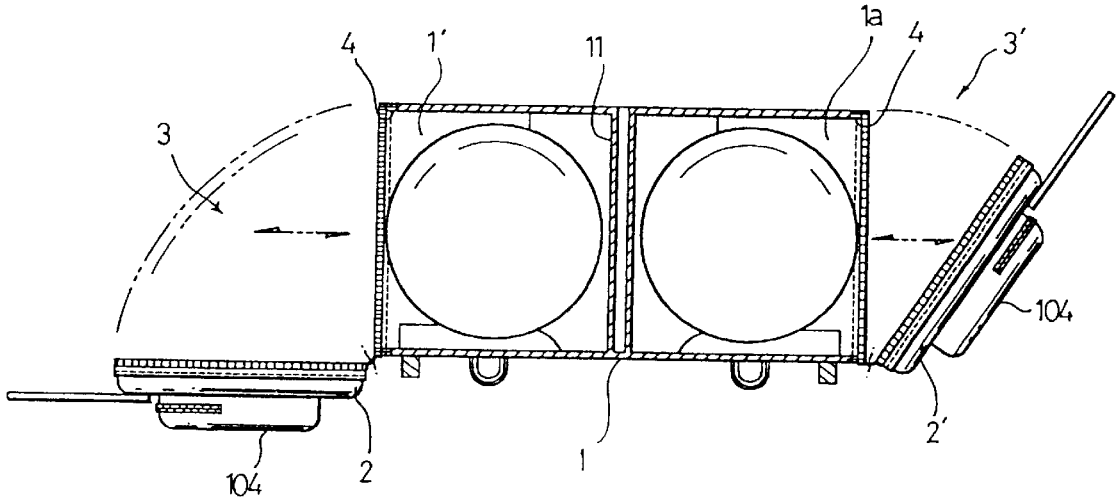
FIG. 3 is a vertical cross-section of FIG. 1.

With reference to FIGS. 1 to 3, a bag body for bowling bags of the present invention includes an elongated body member 1 that is provided with a cavity and side open ends. Two lids 2 are hinged to the body member 1 at the side open ends of the body member 1 to selectively open and close the side open ends, and provided with an exterior pouch 104. A partition 11 is formed in the center portion of the cavity of the body member 1 to divide the cavity into two sub-cavities 1' and 1*a*.

Figure 4:
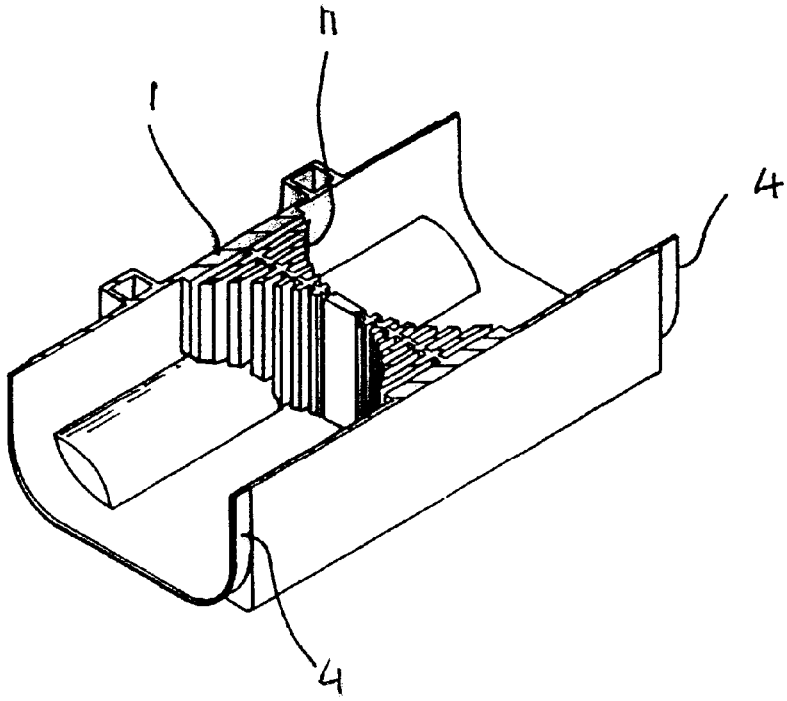
FIG. 4 is a perspective view showing a partition in accordance with another embodiment of the present invention.

Referring to FIG. 4, the partition 11 may be pectinate and integrated with the body member 1 into a single structure.

Figure 5:
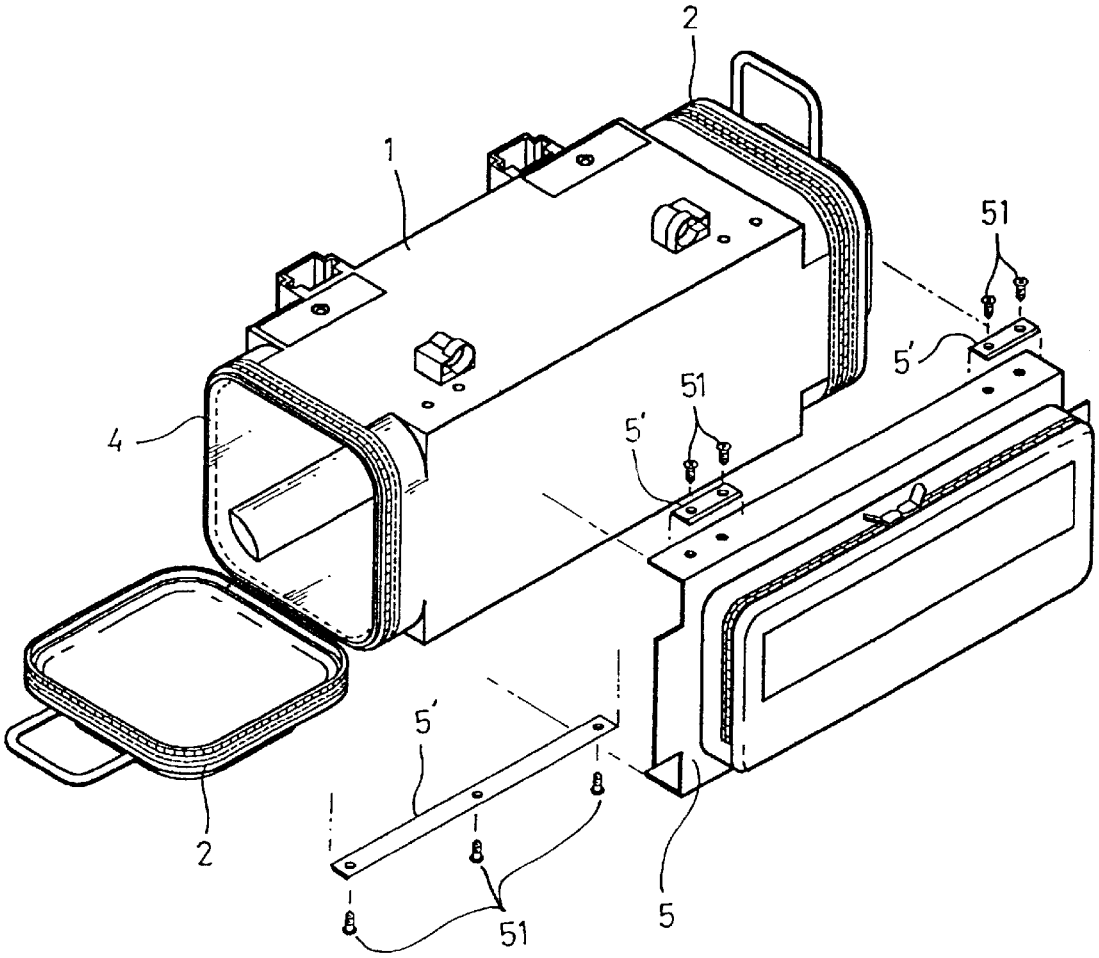
FIGS. 5 and 6 are perspective views showing bag bodies provided with covers.
Figure 6:
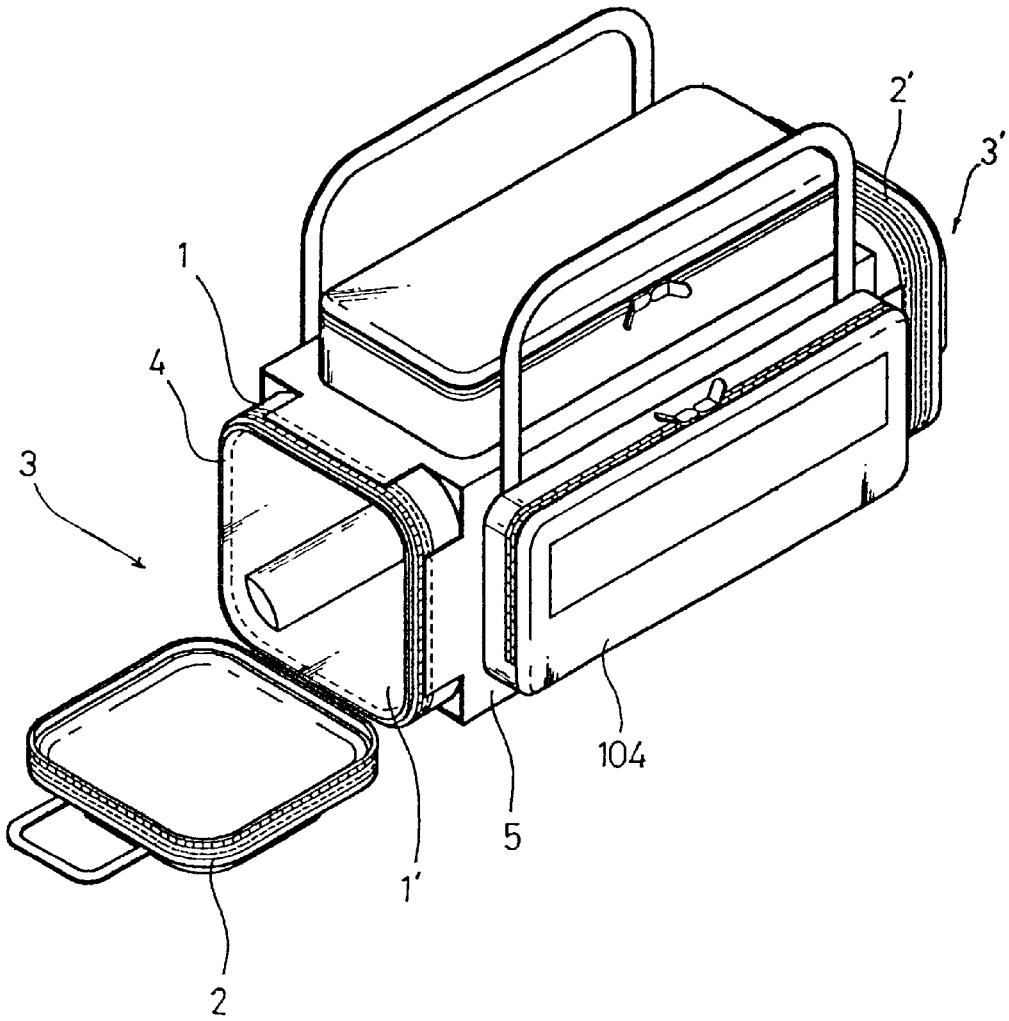

As shown in FIG. 5, the bag body may further comprise a cover 5 made of synthetic resin or leather, and the cover 5 is provided with an auxiliary pouch 104 and secured to the front portion of the body member 1 by means of bars 5' and bolts 51.

Figure 7:
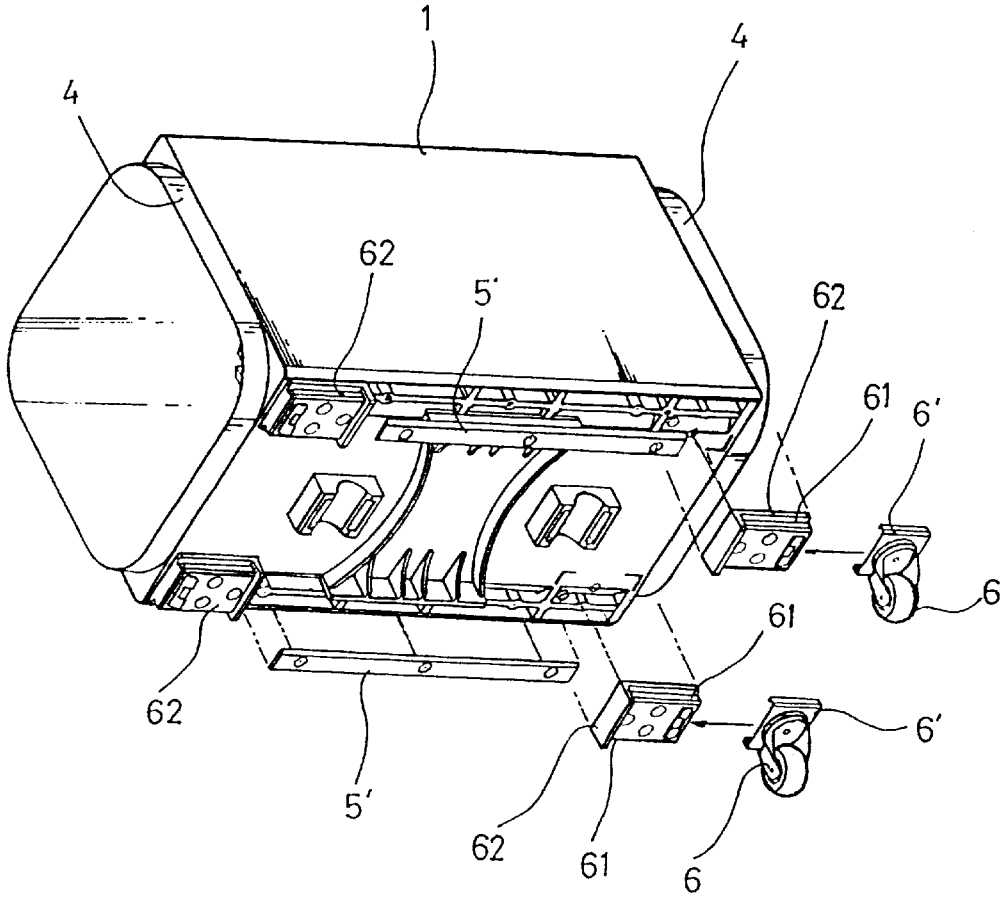
FIG. 7 is a perspective view showing a bag body provided with casters.
Figure 8:
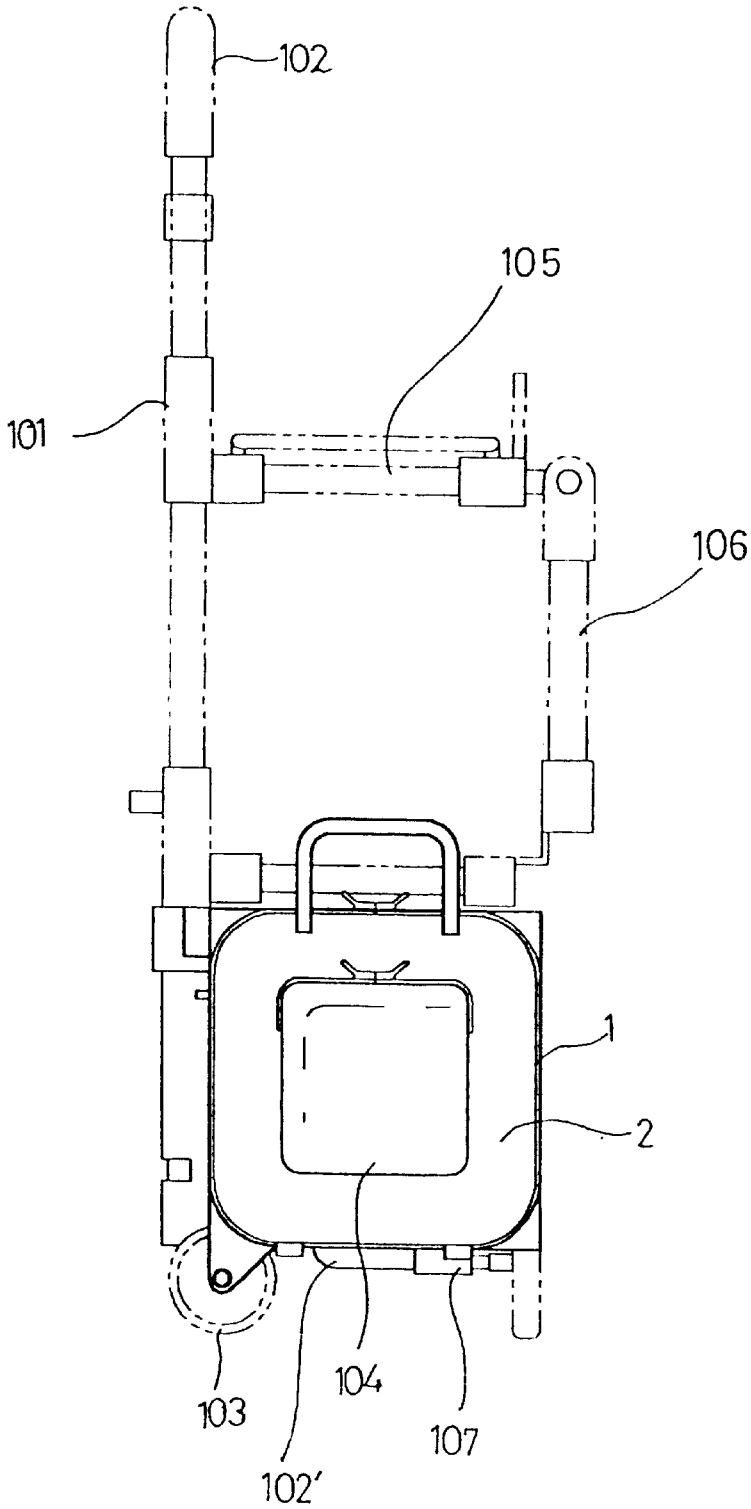
FIGS. 8 to 12 are views showing bag bodies for bowling bags in accordance with other embodiments of the present invention.
Figure 9:
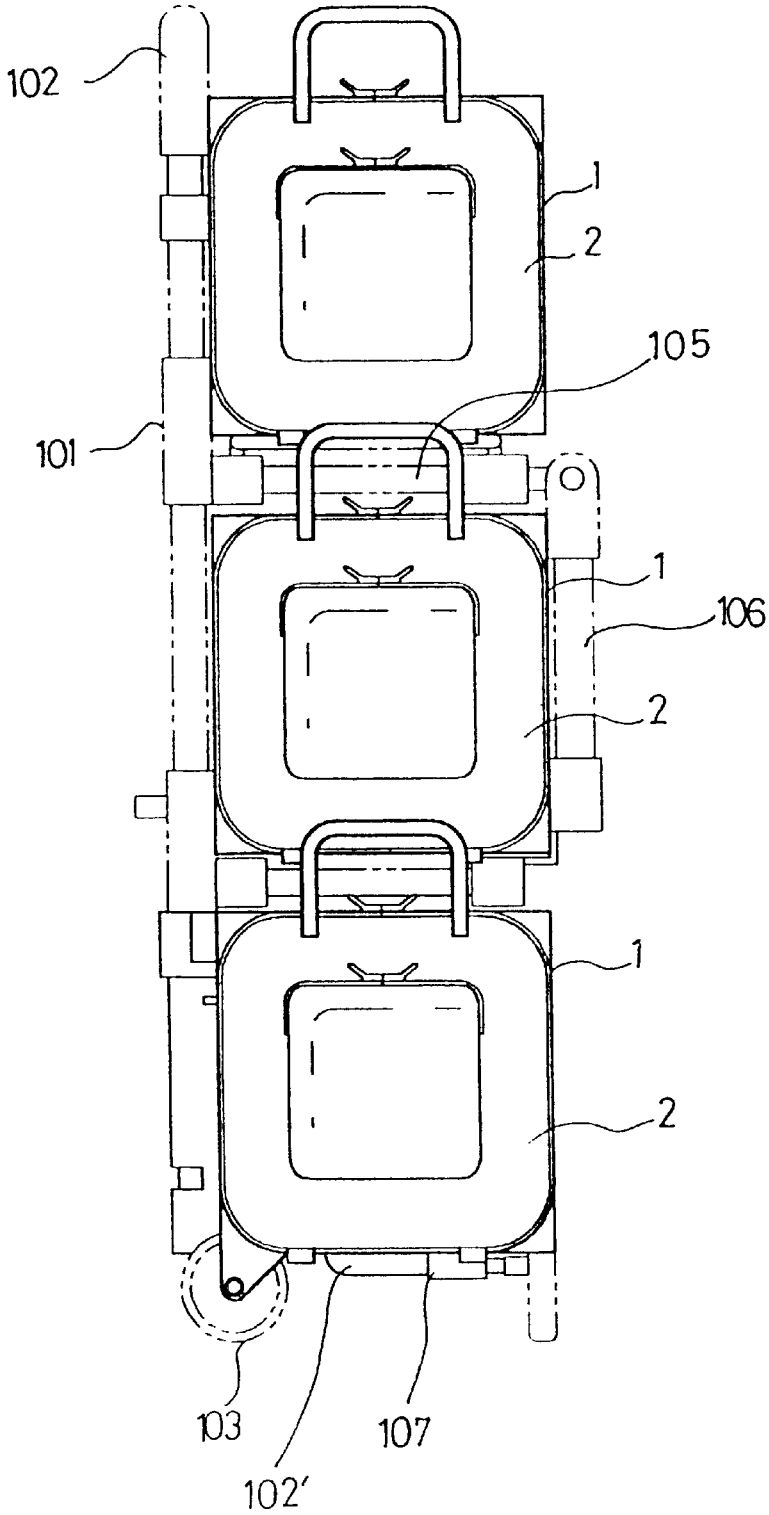
Figure 10:
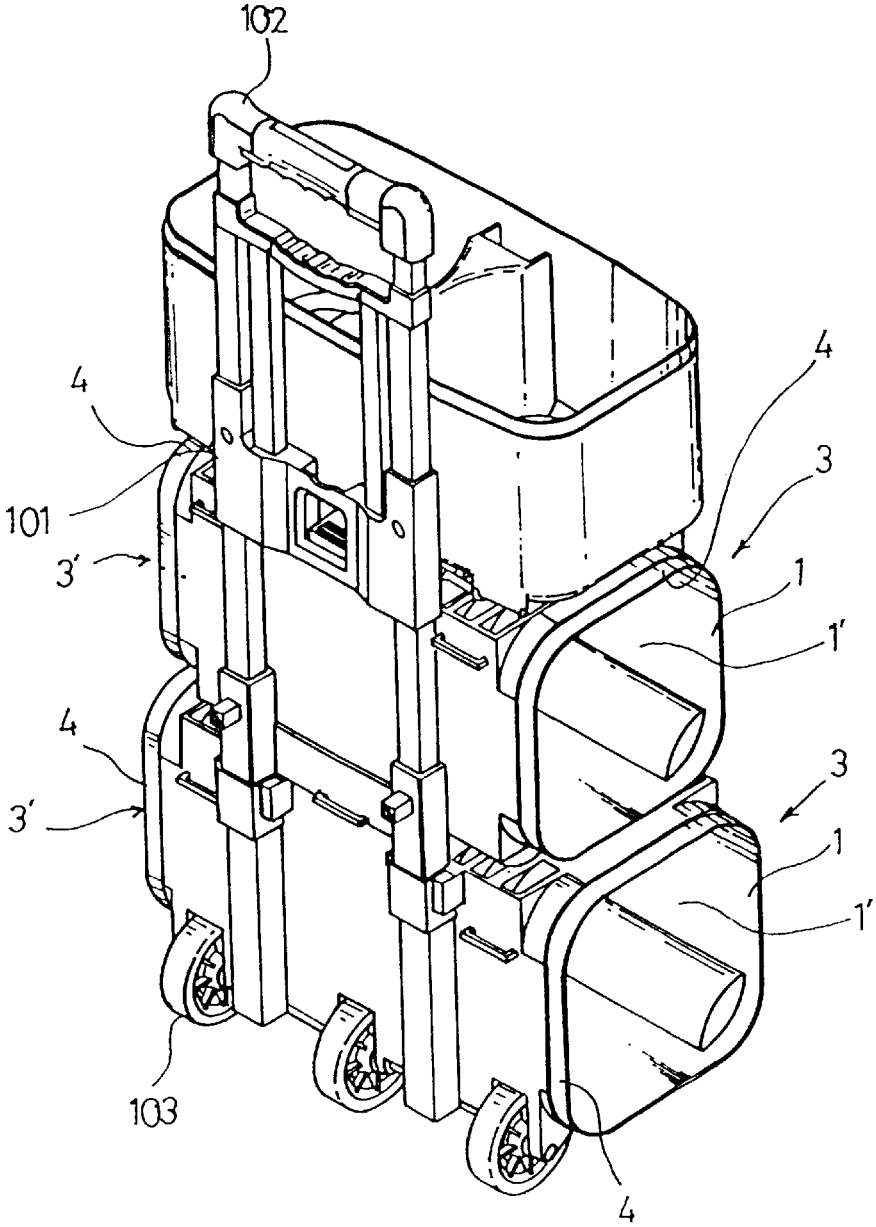
Figure 11:
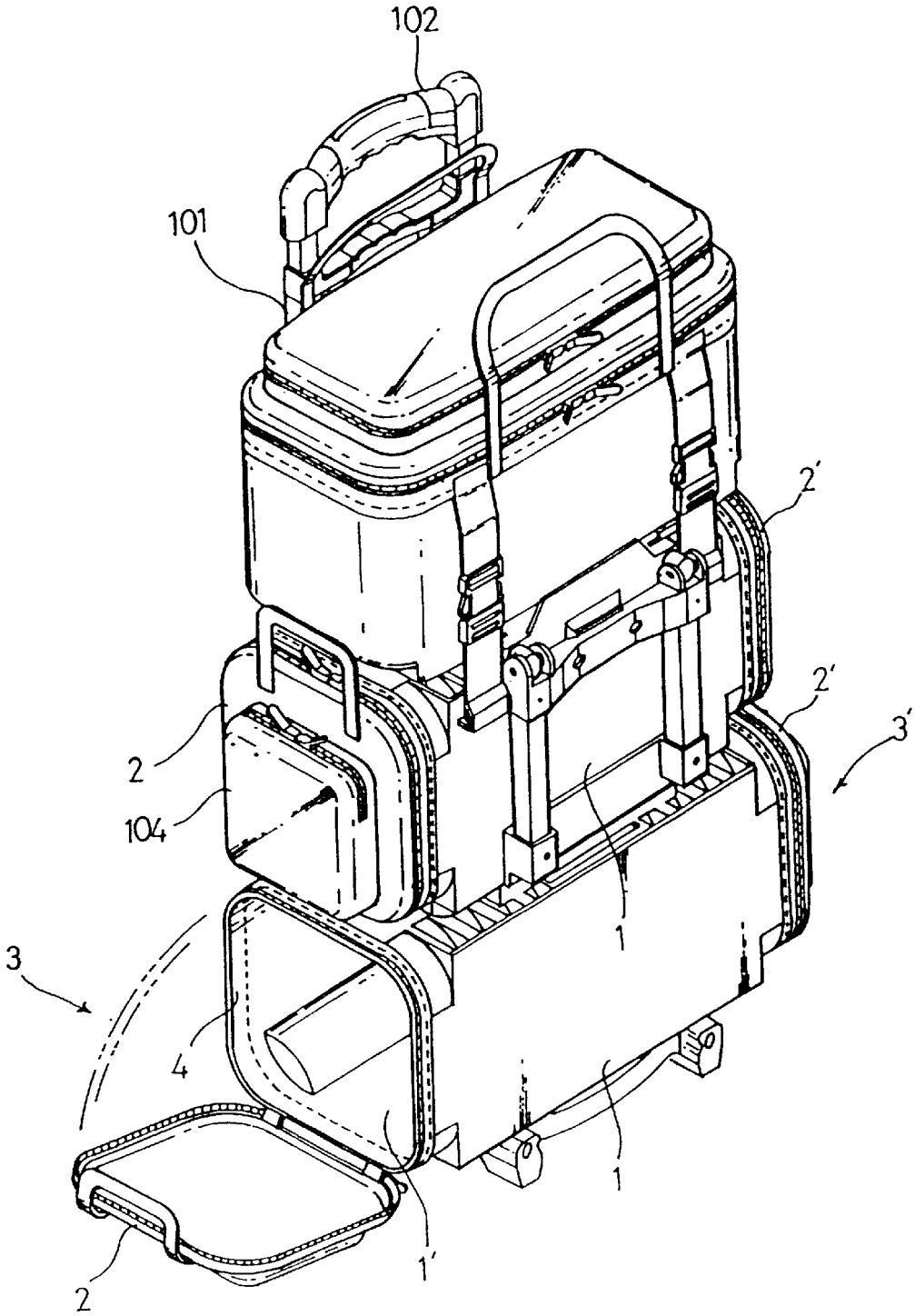
Figure 12:
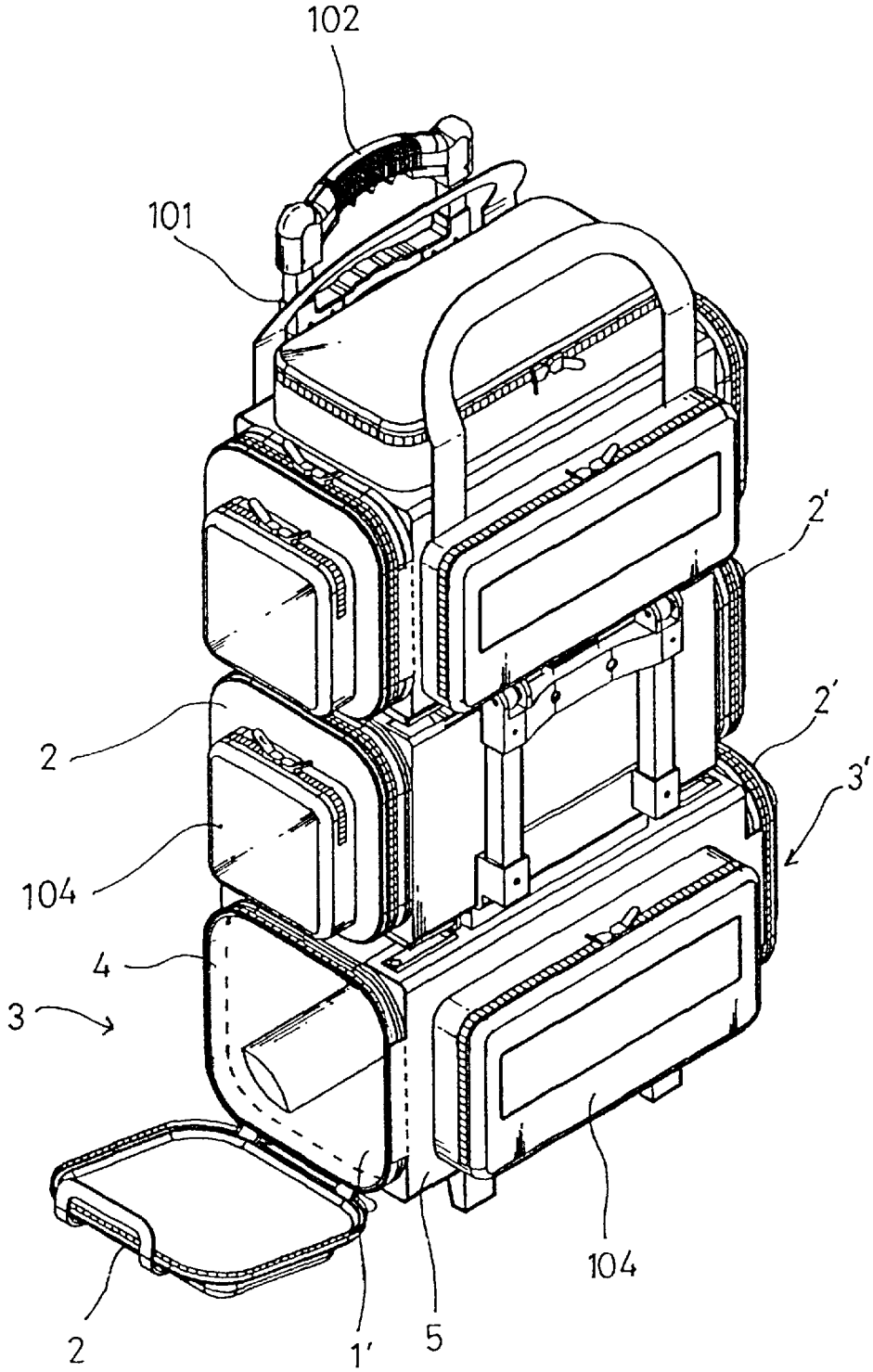

Referring to FIG. 7, the bag body may further comprise a plurality of holding members 62 and a plurality of casters 6. The casters 6 are detachably secured to the holding members 62 secured to the body member 1 with the caster bases 6' of the casters 6 being fitted into the fitting grooves 61 of the holding members 62.

As shown in FIGS. 8 to 12, the bag body may further comprise a carrier. The carrier 101 is attached to the body member 1 and composed of a frame 102 which may include structural members 105, 106, 107 and one or more casters 103. As shown, two or more body members may be detachably fixed to one another with one laid on top of another.

In accordance with the present invention, the cavity is divided into two sub-cavities 1' and 1*a* by the partition 11, and the side open ends 3 and 3' of the bag are selectively opened and closed using lids 2 and 2', thereby allowing bowling balls to be selectively put into and withdrawn from the bag.

Accordingly, bowling balls can be individually kept in the sub-cavities 1' and 1*a* of the bowling bag, so scratches and noises that may occur due to collisions between bowling balls while being carried in the bowling bag can be prevented. In the case where a plurality of bowling bags are attached to the carrier 101 with one laid on top of another, the bowling balls can be individually put into and individually withdrawn from the bowling bags without the problem of a bowling ball falling out of the bowling bag while the carrier 101 is erect. In addition, the bowling balls are individually kept in the sub-cavities 1' and 1*a*, so that the bowling balls can be held stable while the bowling balls are kept and carried in the bags. Moreover, casters 6 may be detachably attached to the body member 1, so the bowling bag of the present invention is advantageous in that a user can carry the bowling bag easily. The body member 1 is covered with the cover 5 made of synthetic resin or leather at its front surface or two or more surfaces, thereby improving the bowling bag's appearance and increasing the accommodating space of the bowling bag by the addition of the pouch. In brief, the bowling bag of the present invention facilitates the keeping and carrying of bowling equipment.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A bowling bag body for at least two bowling balls, comprising:

an elongated body member having a ball cavity and side open ends;

two lids hinged to said body member at the side open ends of said body member, respectively, to selectively open and close the side open ends, at least one of said lids provided with an exterior pouch therein; and a pectinate partition formed in a center portion of the ball cavity of said body member to divide the cavity into two sub-cavities, one for each of two bowling balls and preventing contact therebetween, said partition being integrated with said body member into a single structure.

2. The bag body according to claim 1, further comprising a cover of synthetic resin or leather, said cover being provided with an auxiliary pouch and secured to a front portion of said body member by bars and bolts.

3. The bag body according to claim 1, further comprising a cover provided with auxiliary pouches and secured around said body member by a bar and bolts.

4. The bag body according to claim 1, further comprising a plurality of holding members fastened to said body member and having fitting grooves therein, and a plurality of casters mounted on caster bases, said caster bases being fitted into the fitting grooves of said holding members to detachably secure said casters to said holding members.

5. The bag body according to claim 1, further comprising a carrier, said carrier being attached to said body member and composed of a frame and one or more casters.

6. The bag body according to claim 5, wherein a plurality of said body members are detachably fixed to one another with one laid on top of another on said carrier.

7. The bag body according to claim 1, wherein said partition has two opposing concave sides, each side for contacting a respective bowling ball placed within said body member.

8. The bag body according to claim 1, wherein both of said lids are provided with an exterior pouch.

9. The bag body according to claim 1, wherein each lid provides access to only a respective one of said two sub-cavities.

10. A bowling bag body for at least two bowling balls, comprising:

an elongated body member having a ball cavity and two side open ends;

two lids hinged to said body member at the two side open ends of said body member, each lid for selectively opening and closing a respective one of said two side open ends;

a partition formed in a center portion of the ball cavity of said body member to divide the cavity into two sub-cavities, said partition preventing contact between balls in the two sub-cavities, each lid providing access to only a respective one of said two sub-cavities.

11. The bag body according to claim 10, wherein said partition is pectinate and integrated with said body member into a single structure.

12. The bag body according to claim 10, wherein at least one of said lids is provided with an exterior pouch.

13. The bag body according to claim 10, further comprising a cover of synthetic resin or leather, said cover being provided with an auxiliary pouch and secured to a front portion of said body member by bars and bolts.

14. The bag body according to claim 10, further comprising a cover provided with auxiliary pouches and secured around said body member by a bar and bolts.

15. The bag body according to claim 10, wherein both of said lids are provided with an exterior pouch.

16. A bag body for bowling bags, comprising:

an elongated body member having a cavity and side open ends;

two lids hinged to said body member at the side open ends of said body member to selectively open and close the side open ends, at least one of said lids being provided with an exterior pouch;

a partition formed in a center portion of the cavity of said body member to divide the cavity into two sub-cavities; and a cover provided with an auxiliary pouch and secured to said body member by a bar and bolts.

17. The bag body according to claim 16, wherein said partition is pectinate and integrated with said body member into a single structure.

18. The bag body according to claim 16, further comprising a plurality of holding members fastened to said body member and having fitting grooves therein, and a plurality of casters mounted on caster bases, said caster bases being fitted into the fitting grooves of said holding members to detachably secure said casters to said holding members.

* * * * *